United States Patent [19]

Fujioka et al.

[11] 4,214,444

[45] Jul. 29, 1980

[54] EXHAUST MANIFOLD FOR AN INTERNAL COMBUSTION ENGINE

[75] Inventors: Yasuo Fujioka, Toyota; Kenichi Nakano, Okazaki, both of Japan

[73] Assignee: Toyota Jidosha Kogyo Kabushiki Kaisha, Toyota, Japan

[21] Appl. No.: 883,865

[22] Filed: Mar. 6, 1978

[30] Foreign Application Priority Data

Aug. 1, 1977 [JP] Japan ..... 52-92820

[51] Int. Cl.[2] ..... F01N 7/00

[52] U.S. Cl. ..... 60/322; 85/50 R; 277/235 B

[58] Field of Search ..... 60/282, 322, 323; 277/235 B; 285/187, 189, 223, DIG. 11, 363; 85/50 R, 1 JP

[56] References Cited

U.S. PATENT DOCUMENTS

| | | | |
|---|---|---|---|
| 2,809,130 | 10/1957 | Rappaport | 277/DIG. 6 |
| 2,952,344 | 9/1960 | Pope | 60/323 |
| 3,108,018 | 10/1963 | Lewis | 277/DIG. 6 |
| 3,144,803 | 8/1964 | Briles | 85/50 R |
| 3,184,769 | 5/1965 | Barwood | 85/1 JP |
| 3,202,033 | 8/1965 | Weidner | 85/50 R |
| 3,374,775 | 3/1968 | Ferguson | 60/323 |
| 3,627,334 | 12/1971 | Reddy | 277/166 |
| 3,924,863 | 12/1975 | Nakano | 60/282 |

FOREIGN PATENT DOCUMENTS

| | | | |
|---|---|---|---|
| 1426108 | 9/1962 | Fed. Rep. of Germany | 60/323 |
| 2306078 | 10/1976 | France | 277/235 B |
| 899552 | 6/1962 | United Kingdom | 277/235 B |
| 1191647 | 5/1970 | United Kingdom | 277/DIG. 6 |

*Primary Examiner*—Douglas Hart

*Attorney, Agent, or Firm*—Stevens, Davis, Miller & Mosher

[57] ABSTRACT

The disclosure is relative to an improved fitting structure of an exhaust manifold to a cylinder head of an integral combustion engine for an automobile, in which enough clearance is provided between each of fitting holes, formed in the exhaust manifold and a gasket allowing a bolt to pass therethrough, and the bolt to prevent the exhaust manifold from contacting the bolt even when the exhaust manifold is thermally expanded and a low frictional thermostable member is inserted into at least one of two places, between the exhaust manifold and the gasket and between the exhaust manifold and the bolt head or a nut. The expansion of the exhaust manifold is not restricted by bolts when it is thermally expanded but is slidably displaceable freely along the surface of the cylinder head, therefore, no crevices are formed between the exhaust manifold and the cylinder head.

6 Claims, 4 Drawing Figures

EXHAUST MANIFOLD FOR AN INTERNAL COMBUSTION ENGINE

This invention relates to a fitting structure of an exhaust manifold of an internal combustion engine for an automobile to a cylinder head.

In a conventional engine, an exhaust manifold is tightened to a cylinder head of the engine through a gasket by means of tap bolts or stud bolts and nuts. A usual flat washer or a spring washer is provided below each of the nuts of the stud bolts or the head of the tap bolts, or nothing is provided therebelow. The exhaust manifold is thermally expanded because it is exposed to the exhaust gas having a high temperature, but its displacement is restricted at the tightened portion thereof because its tightening to the cylinder head by the bolts and, consequently, is expanded and deformed between two bolts. Accordingly, crevices are formed between the exhaust manifold and the cylinder head, which causes leakage of the exhaust gas during the running of the engine. Dispersion of the quantity of the noxious ingredients in the exhaust manifold, consequently, occurs and unusual noise is generated caused by the leakage of the exhaust gas.

It is an object of this invention to provide a fitting structure of an exhaust manifold to a cylinder head of an engine, in which the above mentioned conventional disadvantages are eliminated.

It is another object of this invention to provide a low frictional member which may be used to attain the above object easily and economically.

The invention will now be described in further detail by way of example with reference to the accompanying drawings, in which.

Figure 1:
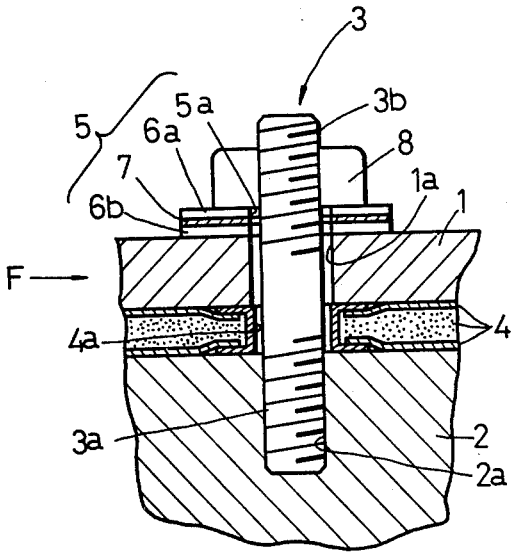
FIG. 1 is a front longitudinal sectional view of essential parts of a first embodiment of this invention.
Figure 2:
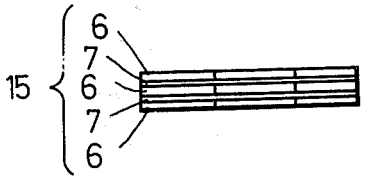
FIG. 2 shows a modification of a part of FIG. 1.

Referring to FIG. 1 illustrating a first embodiment of this invention, a flange 1 of an exhaust manifold of an engine for an automobile and a cylinder head 2 are shown. A threaded end 3*a* of a stud bolt 3 is screwed into a screw hole 2*a* provided in the cylinder head 2. The other end 3*b* of the stud bolt 3 is also threaded. A gasket 4 is provided on the outer side of the cylinder head 2. The stud bolt 3 is passing through a fitting hole 4*a* provided in the gasket 4 and fitting the gasket 4 to the cylinder head 2. There is provided enough clearance between the stud bolt 3 and the fitting hole 4*a* to prevent the exhaust manifold from contacting the bolt 3 even when the exhaust manifold is thermally expanded. On the outside of said gasket 4, a flange 1 of the above exhaust manifold is provided and the stud bolt 3 is passing through a fitting hole 1*a* provided in said flange 1 and fitting said flange 1 to the gasket 4. There is provided enough clearance between the stud bolt 3 and the fitting hole 1*a* in a relation similar to that between the stud bolt 3 and the fitting hole 4*a*. A ring-shaped low frictional washer assembly 5 is provided on the outside of the flange 1 of the exhaust manifold and the stud bolt 3 is passing through a fitting hole 5*a* of the washer assembly 5. There is also provided enough clearance between the fitting hole 5*a* and the stud bolt 3. The low frictional washer assembly consists of two pieces of ring-shaped washer members 6*a* and 6*b* of metallic material and a ring-shaped member 7 of low frictional material, such as scaly natural graphite or thermostable fluorine resin, interposed therebetween. The low frictional washer assembly 5 may be of a multilayer structure 15 as shown in FIG. 2, in which two pieces of low frictional member 7 are held between three pieces of ring-shaped washer members 6 of metallic material. The flange 1 of the exhaust manifold, the gasket 4 and the low frictional washer assembly 5 are tightened firmly to the cylinder head 2 through a nut 8.

The temperature of an exhaust manifold of an automobile is raised up to 400°–500° C. during running of the automobile in a usual condition. The exhaust manifold is expanded and deformed caused by the high temperature, accordingly, a force F acts on the flange 1 in the direction of an arrow in FIG. 1. Consequently, the flat washer member 6*b*, contacting with the flange 1, of the low frictional washer assembly 5 is displaced relative to the washer member 6*a* contacting the nut 8 by the function of the low frictional member 7. A shearing deformation occurs in the gasket 4 caused by the force F. Consequently, the flange 1 of the exhaust manifold, therefore, the exhaust manifold, is free of the stud bolt 3 and displaced relative to the stud bolt 3, accordingly, to the cylinder head 2 along the surface thereof. The expansion, and deformation of the exhaust manifold is, then, prevented and there remains a very scarce possibility for the formation of crevices between the exhaust manifold and the cylinder head. Then there occurs no generation of unusual noises or dispersion of the quantity of the noxious ingredients in the exhaust manifold, which are usually brought about by the leakage of the exhaust gas.

When the multi-layered low frictional washer assembly 15 afore-mentioned is employed instead of the washer assembly 5, the movability of the exhaust manifold relative to the cylinder head 2 is more improved.

Figure 3:
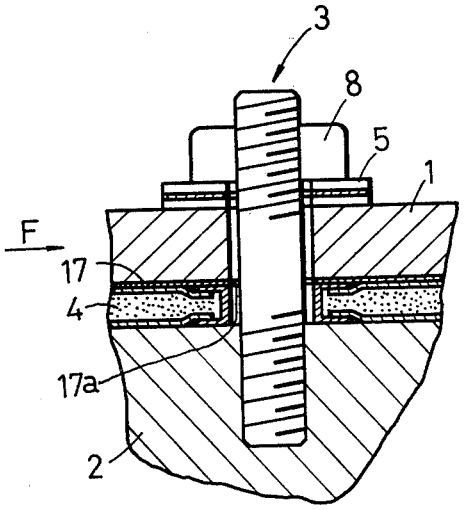
FIG. 3 is a front longitudinal sectional view of essential parts of a second embodiment of this invention.

In a second embodiment of this invention shown in FIG. 3, a low frictional sheet 17 of a low frictional material such as scaly natural graphite or thermostable fluorine resin is inserted between the flange 1 of the exhaust manifold and the gasket 4, but the other structure is identical with that of the first embodiment. A fitting hole 17*a* is provided in the low frictional sheet 17 and a stud bolt 3 is passing through the fitting hole 17*a*. There is provided enough clearance between the fitting hole 17*a* and the stud bolt 3.

In the second embodiment, when a force F act on the flange 1 of the exhaust manifold, the exhaust manifold is not only displaced relative to the flat washer member 6*a*, contacting with the nut 8, of the low frictional washer assembly 5, but also relative to the gasket 4; therefore, the amount of movement of the exhaust manifold in the second embodiment is larger than that in the first embodiment. Consequently, expansion and deformation of the exhaust manifold is prevented even more than in the first embodiment and the prevention of the leakage of the exhaust gas is more improved in the second embodiment in comparison with the first embodiment.

Figure 4:
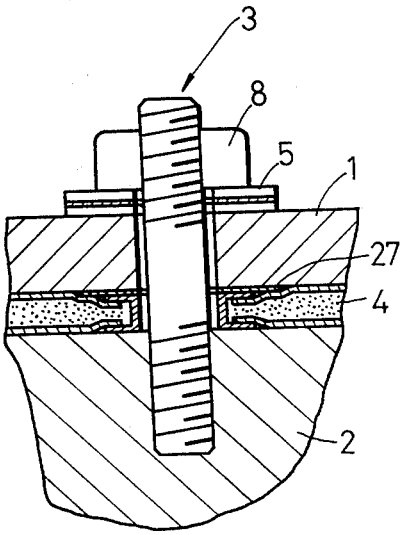
FIG. 4 is a front longitudinal sectional view of a third embodiment of this invention.

In a third embodiment of this invention shown in FIG. 4, a ring-shaped low frictional sheet member 27 is provided only around the stud bolt 3 instead of the low frictional sheet member 17 in the second embodiment. The other structure is quite identical with that of the second embodiment.

In the third embodiment, the movability of the exhaust manifold relative to the cylinder head 2 lies midway between those of the first and the second embodiments. But as the low frictional member 27 is employed only around the stud bolt 3, the manufacturing cost of the assembly becomes lower in the third embodiment than in the second embodiment.

Further, a tap bolt having a head functioning as the nut 8 may be employed in place of the stud bolt 3 and the nut 8 used in the above three embodiments.

What is claimed is:

1. In an internal combustion engine for an automobile having a cylinder head, an exhaust manifold having a flange, and a gasket sandwiched between the flange and the cylinder, the improvement comprising:

a bolt, one end of which is screwed into said cylinder head, said bolt extending through said flange and said gasket;

means, on the other end of said bolt, for tightening the flange, the gasket and the cylinder head together;

a washer assembly sandwiched between said tightening means and said flange, said assembly comprising at least two flat ring-shaped metallic washers and a flat ring-shaped low frictional member between and in contact with the metallic washers; and said assembly, said flange, and said gasket each having a fitting hole defined therethrough through which the bolt extends, each of said fitting holes being of larger transverse cross-sectional area than the bolt to define an annular clearance between the bolt and each of the assembly, the flange and the gasket to prevent the exhaust manifold from contacting the bolt even when the exhaust manifold thermally expands.

2. The invention as set forth in claim 1, wherein said low frictional member is made of scaly natural graphite.

3. The invention as set forth in claim 1, wherein said low frictional member is made of fluorine resin.

4. The invention as set forth in claim 1, wherein:

said tightening means comprises a nut.

5. The invention as set forth in claim 1, further comprising:

a sheet of low frictional material sandwiched between the flange and the gasket.

6. The invention as set forth in claim 1, further comprising:

a ring-shaped sheet member of low frictional material surrounding the bolt and sandwiched between the flange and the gasket.

* * * * *